US009844480B1

(12) United States Patent
Campbell

(10) Patent No.: US 9,844,480 B1
(45) Date of Patent: Dec. 19, 2017

(54) LEG SUPPORT FOR A MOTORIZED CHAIR

(71) Applicant: Minos Campbell, Arlington, TX (US)

(72) Inventor: Minos Campbell, Arlington, TX (US)

( * ) Notice: Subject to any disclaimer, the term of this patent is extended or adjusted under 35 U.S.C. 154(b) by 163 days.

(21) Appl. No.: 15/019,268

(22) Filed: Feb. 9, 2016

(51) Int. Cl.
*A61G 5/12* (2006.01)
*A61G 5/04* (2013.01)

(52) U.S. Cl.
CPC ..... *A61G 5/12* (2013.01); *A61G 5/04* (2013.01); *A61G 5/127* (2016.11); *A61G 2005/127* (2013.01)

(58) Field of Classification Search
None
See application file for complete search history.

(56) References Cited

U.S. PATENT DOCUMENTS 2,609,864 A 9/1952 Gates
3,865,427 A 2/1975 Delany
4,425,863 A * 1/1984 Cutler ..... B63B 29/04 114/194
4,572,577 A 2/1986 LaRue
4,654,904 A 4/1987 Britz
4,767,160 A * 8/1988 Mengshoel ..... A47C 7/52 248/188.7
D350,921 S 9/1994 Carroll
6,142,571 A * 11/2000 Benden ..... A47C 7/004 297/423.4
6,607,246 B1 * 8/2003 Benden ..... A47C 7/004 297/423.4
7,669,934 B1 * 3/2010 Cline ..... A47C 7/503 297/217.3
8,201,842 B1 6/2012 Waters
8,246,118 B2 * 8/2012 Moore ..... A47C 7/506 297/423.1
8,640,290 B1 * 2/2014 Avett ..... A47C 20/02 5/652
8,856,988 B2 * 10/2014 Frazier ..... A61F 2/601 5/624
2009/0179399 A1 7/2009 Mehl

* cited by examiner

*Primary Examiner* — David E Allred
(74) *Attorney, Agent, or Firm* — Kyle A. Fletcher, Esq.

(57) ABSTRACT

The leg support for a motorized chair is an accessory that is adapted to be mounted onto a motorized chair in order to support a leg of an end user that is riding said motorized chair. The leg support includes a first armature that is adapted to be affixed to and extend upwardly from a motorized chair floor surface. The first armature may employ the use of at least one mounting bracket to rigidly affix the first armature to the motorized chair. The first armature extends upwardly and includes a bend that designates a second armature portion. A leg rest is selectively bolted to the second armature portion. The leg rest is supported at a horizontal orientation with respect to the motorized chair. The leg rest includes at least one leg rest bracket to secure the leg rest to the second armature portion.

18 Claims, 5 Drawing Sheets

LEG SUPPORT FOR A MOTORIZED CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of motorized chairs, more specifically, an accessory that supports a leg of an end user on a motorized chair.

SUMMARY OF INVENTION

The leg support for a motorized chair is an accessory that is adapted to be mounted onto a motorized chair in order to support a leg of an end user that is riding said motorized chair. The leg support includes a first armature that is adapted to be affixed to and extend upwardly from a motorized chair floor surface. The first armature may employ the use of at least one mounting bracket to rigidly affix the first armature to the motorized chair. The first armature extends upwardly and includes a bend that designates a second armature portion. A leg rest is selectively bolted to the second armature portion. The leg rest is supported at a horizontal orientation with respect to the motorized chair. The leg rest includes at least one leg rest bracket to secure the leg rest to the second armature portion. The at least one leg rest bracket is selectively detached from the second armature portion such that the leg rest may be reversed in order to adaptively support either leg of the end user that is riding the motorized chair.

These together with additional objects, features and advantages of the leg support for a motorized chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the leg support for a motorized chair in detail, it is to be understood that the leg support for a motorized chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the leg support for a motorized chair.

It is therefore important that the claims be regarded as including such equivalent construction insofar as they do not depart from the spirit and scope of the leg support for a motorized chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
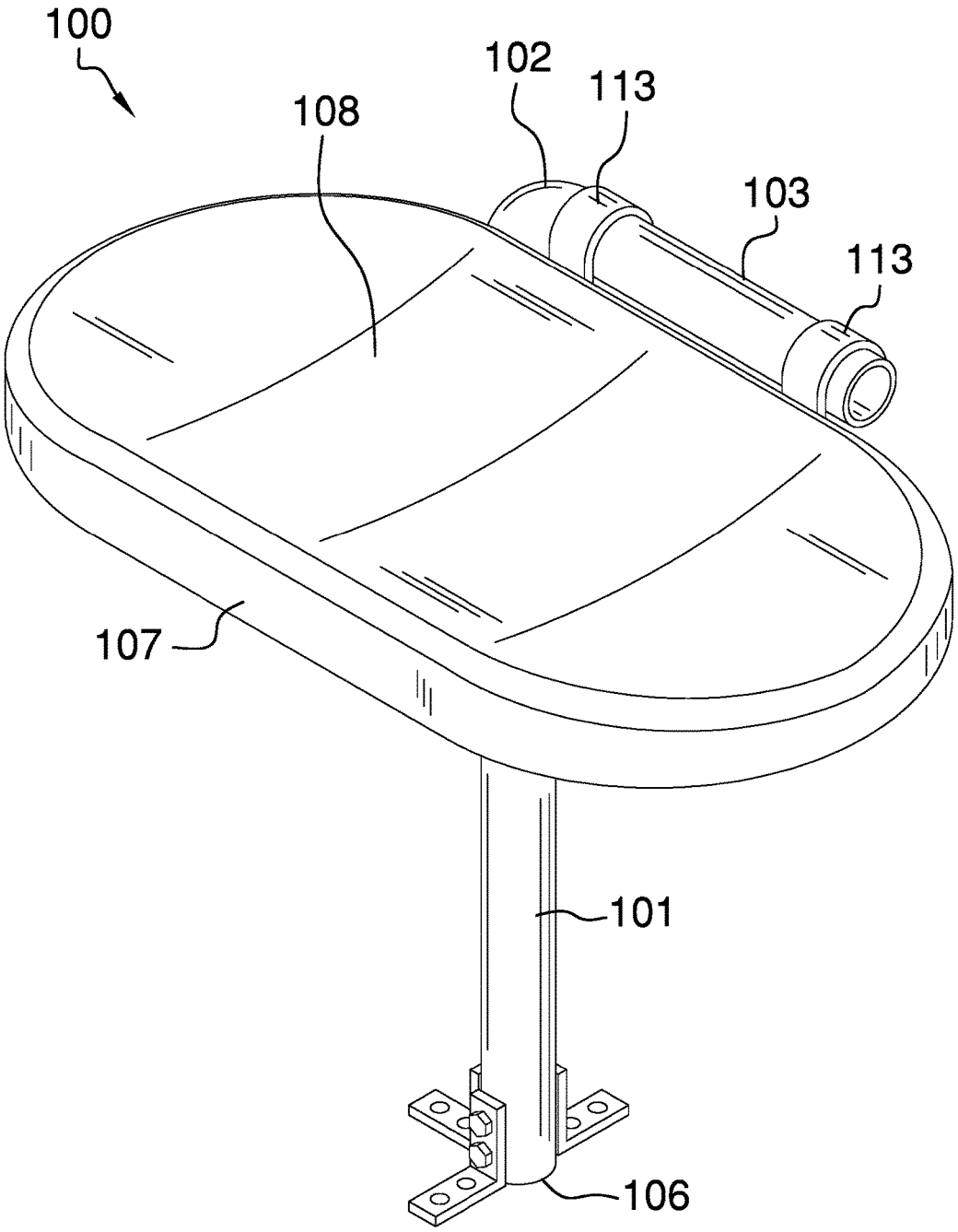
FIG. 1 is a perspective view of an embodiment of the disclosure.
Figure 2:
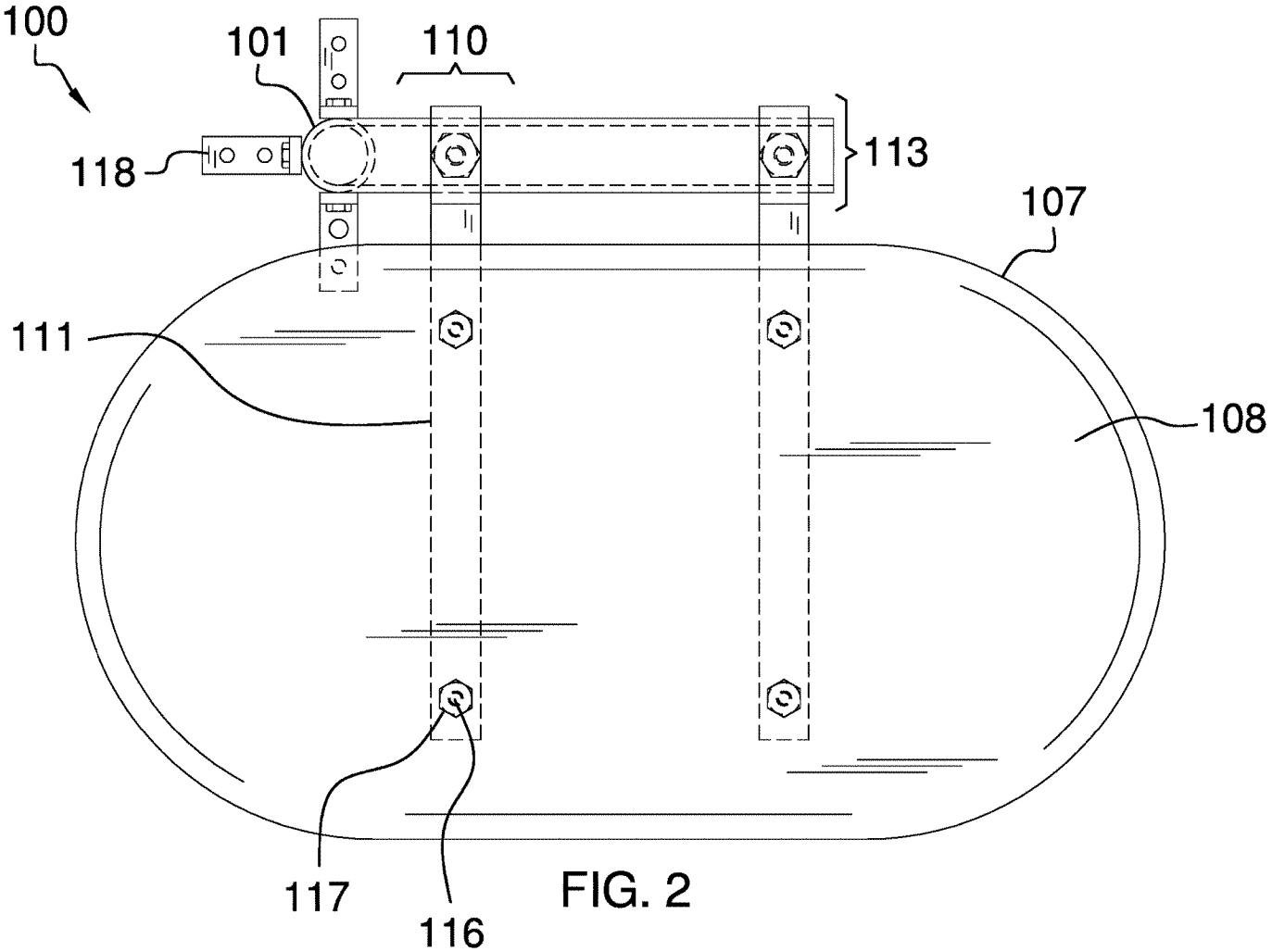
FIG. 2 is a top view of an embodiment of the disclosure.
Figure 3:
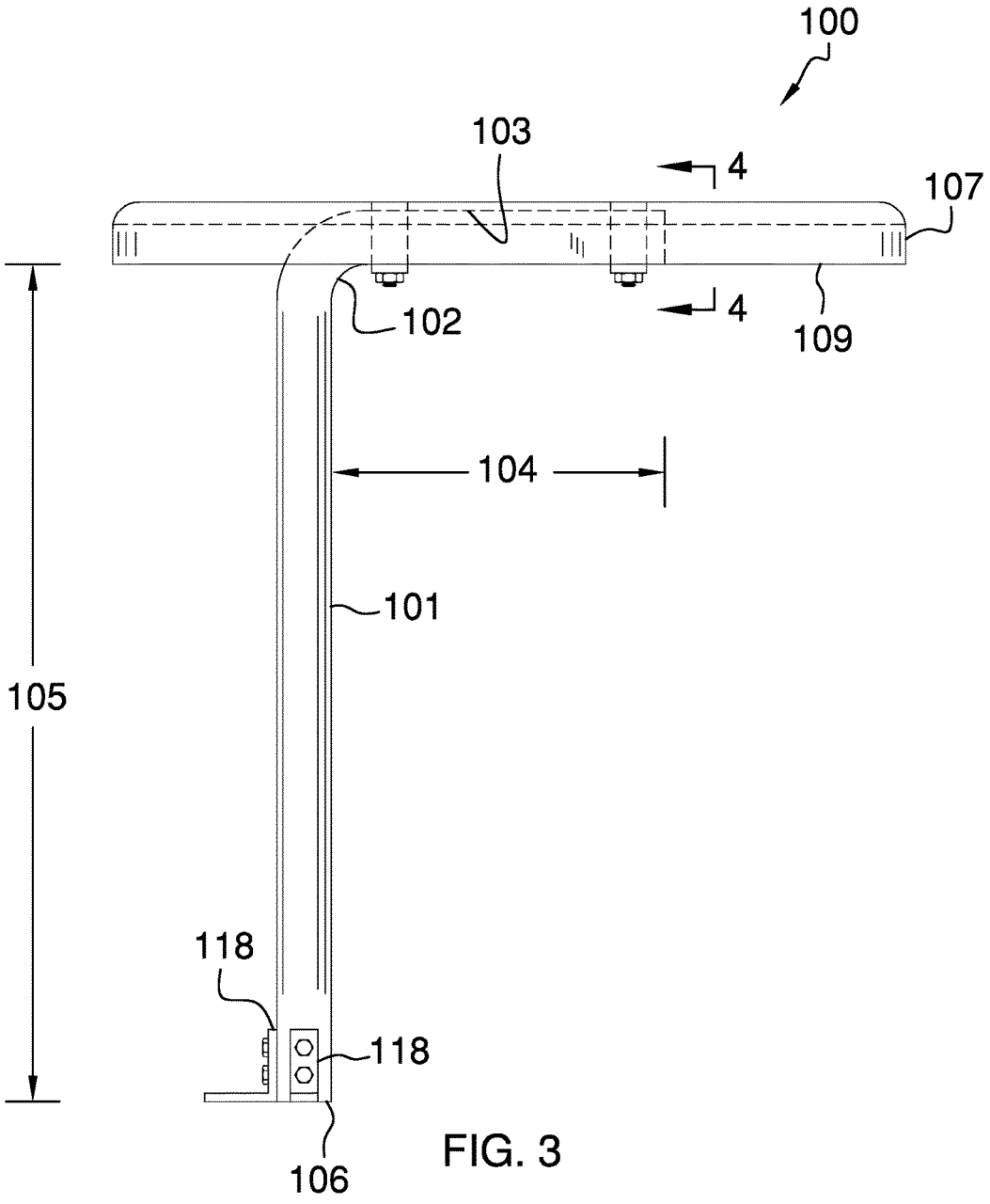
FIG. 3 is a side view of an embodiment of the disclosure.
Figure 4:
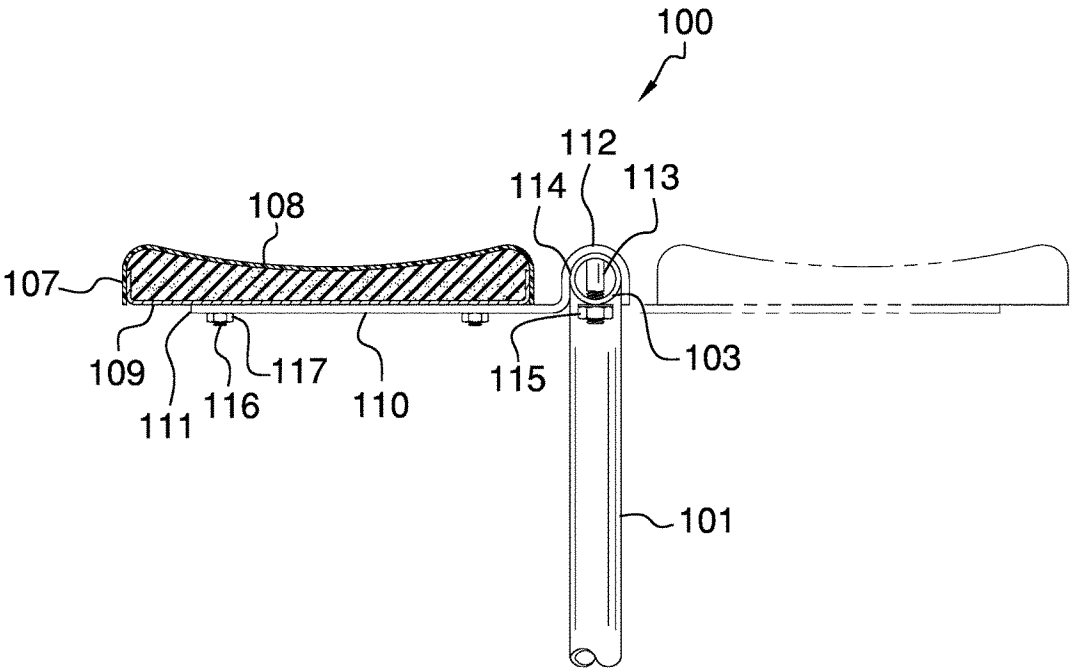
FIG. 4 is a cross-sectional view of an embodiment of the disclosure along line 4-4 in FIG. 3.
Figure 5:
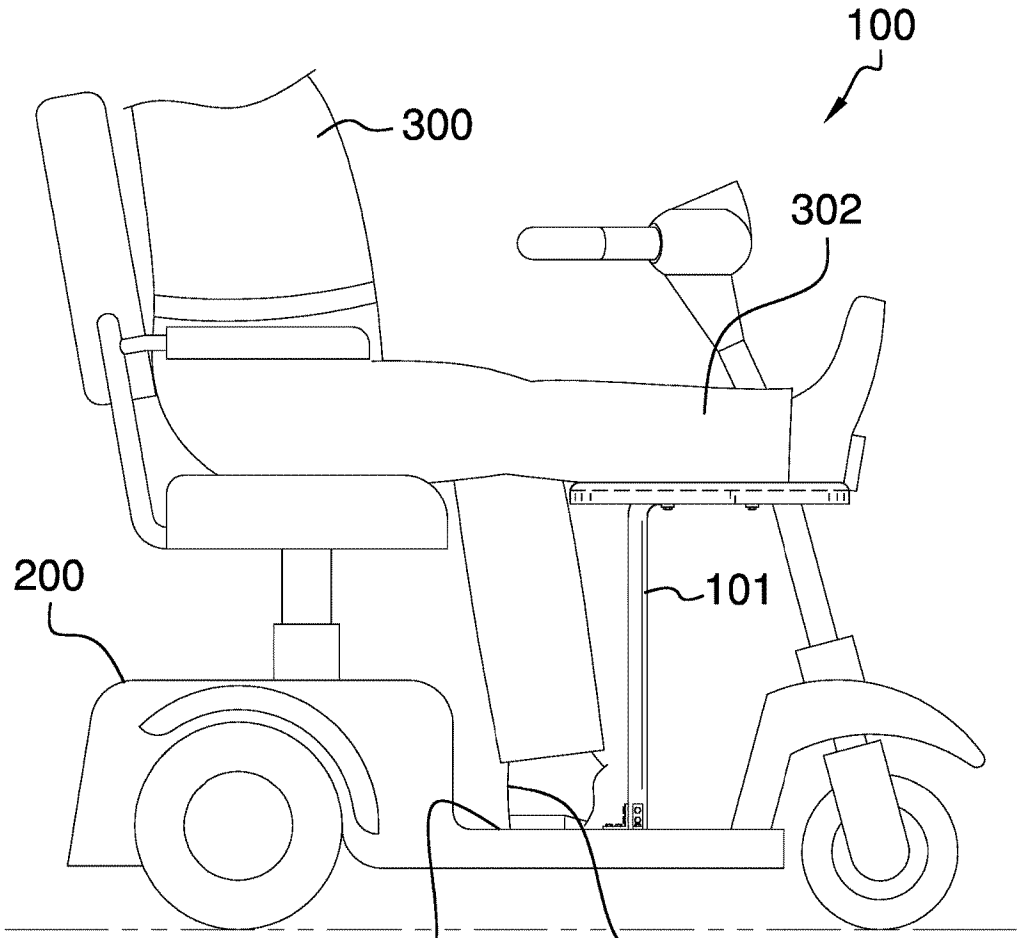
FIG. 5 is a view of an embodiment of the disclosure in use.

Detailed reference will now be made to a multiple potential embodiments of the disclosure, which are illustrated in FIGS. 1 through 5.

The leg support for a motorized chair 100 (hereinafter invention) comprises a first armature 101 that is a pole of an undefined length. The first armature 101 is vertically oriented, and further defined with a bend 102. The bend 102 designates a second armature portion 103. The bend 102 is a 90-degree bend in the first armature 101, and the second armature portion 103 extends from the bend 102.

The second armature portion 103 is horizontally oriented, and further defined with a second length 104. The second length is not less than 1 inch, but not greater than 3 feet. The first armature 101 extends a first height 105. The first height 105 is not less than 1 inch, but not greater than 3 feet. The first armature is further defined with a first distal end 106. The first distal end 106 is where the first armature 101 adaptively engages a motorized chair 200. More specifically, the motorized chair 200 is further defined with a motorized chair floor surface 201 where a rider 300 places his or her feet 301 thereon. The first distal end 106 is adapted to interface with the motorized chair floor surface 201.

The invention 100 includes a leg rest 107. The leg rest 107 is able to be secured to the second armature portion 103. Moreover, both the leg rest 107 and the second armature portion 103 are horizontally oriented with respect to the motorized chair floor surface 201. The leg rest 107 is further defined with a top rest surface 108 that is concave. The top rest surface 108 is adapted to receive a leg 302 of the end user 300 thereon. The leg rest 107 has an overall shape that resembles an elongated circle. The leg rest 107 is made of a soft foam material. The leg rest 107 is also further defined with a bottom rest surface 109. The bottom rest surface 109 is generally flat.

At least one leg rest bracket 110 is provided with the invention 100. The at least one leg rest bracket 110 secures between the bottom rest surface 109 of the leg rest 107 and the second armature portion 103. The at least one leg rest bracket 110 is responsible for supporting the leg rest 107 at a horizontal orientation with respect to the motorized chair floor surface 201 of the motorized chair 200.

The at least one leg rest bracket 110 is further defined with a flat portion 111 affixed to a semi-circular bend portion 112. The semi-circular bend portion 112 wraps over top of the second armature portion 103, and a bolt member 113 extends there through. The bolt member 113 is oriented downwardly, and extends across bolt holes 114 provided on the second armature portion 103. The bolt member 113 includes a nut 115 to secure the bolt member 113 to the second armature portion 103.

The bottom rest surface 109 of the leg rest 107 includes leg bolts 116 that extend downwardly, and extend across the flat portion 111 of the at least one leg rest bracket 110. Leg nuts 117 secure the leg bolts 116 in place with respect to the flat portion 111 of the at least one leg rest bracket 110.

The first armature 101 includes at least one chair bracket 118 to secure the first armature 101 to the motorized chair 200. The at least one chair bracket 118 is adapted to mount onto the motorized chair floor surface 201 of the motorized chair 200. The at least one chair bracket 118 attach to the first armature 101 adjacent to the first distal end 106. The at least one chair bracket 118 is an angled bracket that forms a 90-degree bend so as to fasten to the first armature 101 as well as adaptively to the motorized chair 200.

The first armature 101, the at least one chair bracket 118, and the at least one leg rest bracket 110 are made of a material comprising a plastic, wood, metal, carbon fiber composite. The leg rest 107 may be made of a soft foam, a wood, a metal, a plastic, a carbon fiber composite. Moreover, the leg rest 107 may be made with a Visco-elastic foam that is encased within an outer casing.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A leg support for a motorized chair comprising:

a first elongate armature adapted to be secured to said motorized chair and a second armature portion connected to and extending lengthwise transversely from the first armature;

wherein the first armature is lengthwise vertically oriented, and is selectively attached to a leg rest by at least one leg rest bracket having a flat portion secured to an underside of the leg rest, the leg rest bracket having a semi-circular bend portion secured over a top of the second armature portion;

wherein said leg rest is adapted to support a leg of an end user who is riding on said motorized chair.

2. The leg support according to claim 1 wherein the first armature is a pole of a first length; wherein the first armature is further defined with a bend.

3. The leg support according to claim 2 wherein the bend connects the first armature to the second armature portion; wherein the bend is a 90-degree bend in the first armature, and the second armature portion extends from the bend.

4. The leg support according to claim 3 wherein the second armature portion is horizontally oriented, and further defined with a second length.

5. The leg support according to claim 4 wherein the second length is not less than 1 inch, but not greater than 3 feet.

6. The leg support according to claim 4 wherein the first armature extends a first height.

7. The leg support according to claim 6 wherein the first height is not less than 1 inch, but not greater than 3 feet.

8. The leg support according to claim 6 wherein the first armature is further defined with a first distal end; wherein the first distal end is where the first armature adaptively engages the motorized chair.

9. The leg support according to claim 8 wherein the motorized chair is further defined with a motorized chair floor surface where a rider places his or her feet thereon.

10. The leg support according to claim 9 wherein the first distal end is adapted to interface with the motorized chair floor surface.

11. The leg support according to claim 10 wherein both the leg rest and the second armature portion are lengthwise horizontally oriented with respect to the motorized chair floor surface.

12. The leg support according to claim 11 wherein the leg rest is further defined with a top rest surface that is concave; wherein the top rest surface is adapted to receive the leg of the end user thereon.

13. The leg support according to claim 12 wherein the leg rest has an overall shape that resembles an elongated circle.

14. The leg support according to claim 13 wherein the underside of the leg rest is also further defined with a bottom rest surface;

wherein the bottom rest surface is generally flat.

15. The leg support according to claim 14 wherein the at least one leg rest bracket is responsible for supporting the leg rest at a horizontal orientation with respect to the motorized chair floor surface of the motorized chair.

16. The leg support according to claim 15 wherein, and a bolt member extends through the second armature portion; wherein the bolt member is oriented downwardly, and extends across bolt holes provided on the second armature portion; wherein the bolt member includes a nut to secure the bolt member to the second armature portion.

17. The leg support according to claim 16 wherein the bottom rest surface of the leg rest includes leg bolts that extend downwardly, and extend across the flat portion of the at least one leg rest bracket; wherein leg nuts secure the leg bolts in place with respect to the flat portion of the at least one leg rest bracket.

18. The leg support according to claim 17 wherein the first armature includes at least one chair bracket to secure the first armature to the motorized chair; wherein the at least one chair bracket is adapted to mount onto the motorized chair floor surface of the motorized chair; wherein the at least one chair bracket attach to the first armature adjacent to the first distal end; wherein the at least one chair bracket is an angled bracket that forms a 90-degree bend so as to fasten to the first armature as well as adaptively to the motorized chair.

* * * * *